United States Patent [19]

White

[11] Patent Number: 4,893,639

[45] Date of Patent: Jan. 16, 1990

[54] DENSIFIED PARTICULATE MATERIALS FOR SMOKING PRODUCTS AND PROCESS FOR PREPARING THE SAME

[75] Inventor: Jackie L. White, Pfafftown, N.C.

[73] Assignee: R. J. Reynolds Tobacco Company, Winston-Salem, N.C.

[21] Appl. No.: 888,534

[22] Filed: Jul. 22, 1986

[51] Int. Cl.[4] ..... A24C 15/18; A24D 1/18

[52] U.S. Cl. ..... 131/369; 131/353; 131/359; 131/370; 131/375

[58] Field of Search ..... 131/369, 370, 375, 359, 131/353, 355

[56] References Cited

U.S. PATENT DOCUMENTS

| | | |
|---|---|---|
| Re. 27,214 | 11/1973 | Nakahara . |
| 1,985,840 | 12/1934 | Sadtler . |
| 2,907,686 | 10/1959 | Siegel . |
| 3,277,520 | 10/1966 | Nakahara . |
| 3,545,448 | 12/1970 | Morman et al. . |
| 3,579,719 | 5/1971 | Moriya . |
| 3,584,334 | 6/1971 | Moriya . |
| 3,608,560 | 9/1971 | Briskin et al. . |
| 3,738,374 | 6/1973 | Bennett . |
| 3,741,703 | 6/1973 | Reynolds . |
| 3,805,803 | 4/1974 | Hedge et al. . |
| 3,818,915 | 6/1974 | Anderson . |
| 3,831,609 | 8/1974 | Briskin et al. . |
| 3,834,398 | 9/1974 | Briskin et al. . |

(List continued on next page.)

FOREIGN PATENT DOCUMENTS

| | | |
|---|---|---|
| 117355 | 9/1984 | European Pat. Off. . |
| 956544 | 4/1964 | United Kingdom . |
| 1431045 | 4/1976 | United Kingdom . |

OTHER PUBLICATIONS

Murthy et al., Pharmaceutical Engineering, Jul.-Aug. (1983), pp. 19-28.

Gebbett, Powtech '73-pp. 1-5 "Particulate Matter".

Woodruff et al., Journal Pharmaceutical Sciences, 61:(5), 787-790 (1972).

Luwa Corporation-Charlotte, N.C. "Marumerizer" Product Bulletin (1983).

Luwa Corporation-Charlotte, N.C. "Xtuder"-Produce Bulletin (1983).

Fuji Paudal Co., Ltd.-Catalog of Pulverizing, etc. Equipment.

Reynolds, reprint from Mfg. Chemist & Aerosol News, Jun. 1970.

Ph.D. Thesis-H. J. Malinowski (1971), "Evaluation of Binders for use in the Preparation of Spherical Particles".

Engelleitner, "Selection of the Proper Agglomeration Process" 1981.

*Primary Examiner*—V. Millin

*Attorney, Agent, or Firm*—Grover M. Myers; David G. Conlin

[57] ABSTRACT

The present invention is directed to densified particulate materials and to a process of preparing such materials.

The present invention is also related to cigarette-type smoking articles utilizing the densified particulate materials of the present invention as an extender of the fuel and/or as a flavor enhancer.

In cigarette-type smoking articles, the densified particulate material of the present invention may also serve as a substrate or carrier for an aerosol forming substance. The use of densified particulate tobacco, in whole or in part, as such a substrate affords many advantages heretofore unavailable in cigarette-type smoking articles.

The use of the densified particulate materials of the present invention in conventional tobacco products, e.g., cigarettes, cigars, pipe tobacco, and the like, affords advantages heretofore unavailable. Preferably, a mixture of densified carbon and densified tobacco is used, both as an extender/filler and as a flavor enhancer.

13 Claims, 1 Drawing Sheet

U.S. PATENT DOCUMENTS 3,885,574 5/1975 Borthwick et al. .
3,931,824 7/1976 Miano et al. .
3,933,082 11/1976 Martin et al. .
3,943,941 3/1976 Boyd et al. .
3,943,942 3/1976 Anderson et al. .
4,014,349 3/1977 Morman et al. .
4,019,521 4/1976 Briskin .
4,022,176 1/1977 Anderson .
4,044,777 8/1977 Boyd et al. .
4,079,742 3/1978 Rainer et al. .
4,119,104 10/1978 Roth .
4,133,317 1/1979 Briskin .
4,136,975 1/1979 Forseth .
4,182,736 1/1980 Gunnell .
4,219,031 8/1980 Rainer et al. .
4,244,381 1/1981 Lendvay .
4,256,123 3/1982 Lendvay et al. .
4,256,126 3/1981 Seligman et al. .
4,286,604 9/1981 Ehretsmann et al. .
4,326,544 4/1982 Hardwick et al. .
4,340,072 7/1982 Bolt et al. .
4,371,454 1/1983 Hisatsugu et al. .
4,391,285 7/1983 Burnett et al. .
4,474,191 10/1984 Steiner .
4,481,958 11/1984 Rainer et al. .
4,513,756 4/1985 Pihman et al. .

DENSIFIED PARTICULATE MATERIALS FOR SMOKING PRODUCTS AND PROCESS FOR PREPARING THE SAME

BACKGROUND OF THE INVENTION

The present invention relates to densified particulate materials and the use of such materials, as either all or a part of the material being smoked, in smoking products, such as cigarettes, cigars, pipes, tobacco, and the like, as well as pipe and/or cigarette-type smoking articles. Preferably, these densified particulate materials are selected from tobacco and/or carbon.

Many tobacco substitute smoking materials have been proposed through the years, especially over the last 20 to 30 years. These proposed tobacco substitutes have been prepared from a wide variety of treated and untreated materials, especially cellulose based materials. Numerous patents teach proposed tobacco substitutes made by modifying cellulosic materials, such as by oxidation, by heat treatment, or by the addition of materials to modify the properties of the cellulose. One of the most complete lists of these substitutes is found in U.S. Pat. No. 4,079,742 to Rainer et al.

Many patents describe the preparation of proposed smoking materials from various types of carbonized (i.e., pyrolyzed) cellulosic material. These include U.S. Pat. No. 2,907,686 to Siegel, U.S. Pat. No. 3,738,374 to Bennett, U.S. Pat. Nos. 3,943,941 and 4,044,777 to Boyd et al., U.S. Pat. Nos. 4,019,521 and 4,133,317 to Briskin, U.S. Pat. No. 4,219,031 to Rainer, U.S. Pat. No. 4,286,604 to Ehretsmann et al., U.S. Pat. No. 4,326,544 to Hardwick et al., U.S. Pat. No. 4,481,958 to Rainer et al., Great Britain Pat. No. 956,544 to Norton, Great Britain Pat. No. 1,431,045 to Boyd et al., and European Patent Application No. 117,355 by Hearn, et al.

In addition, U.S. Pat. No. 3,738,374 to Bennett teaches that tobacco substitutes may be made by extruding carbon or graphite fibers, mat or cloth, most of which are made by the controlled pyrolysis of cellulosic materials, such as rayon yarn or cloth.

Other patents describe the use of carbon or pyrolyzed cellulosic material either as a component of proposed smokable materials or as a filler for such materials. These include U.S. Pat. No. 1,985,840 to Sadtler, U.S. Pat. Nos. 3,608,560, 3,831,609, and 3,834,398 to Briskin, U.S. Pat. No. 3,805,803 to Hedge, U.S. Pat. No. 3,885,574 to Borthwick et al., U.S. Pat. No. 3,931,284 to Miano et al., U.S. Pat No. 3,993,082 to Martin et al., U.S. Pat. No. 4,199,104 to Roth, U.S. Pat. Nos. 4,244,381 and 4,256,123 to Lendvay et al., U.S. Pat. No. 4,340,072 to Lanzillotti et al., U.S. Pat. No. 4,391,285 to Burnett et al., and U.S. Pat. No. 4,474,191 to Steiner.

Still other patents describe the partial pyrolysis of cellulosic materials to prepare proposed smoking materials. These include U.S. Pat. Nos. 3,545,448 and 4,014,349 to Morman et al., U.S. Pat. Nos. 3,818,915, 3,943,942 and 4,002,176 to Anderson, and U.S. Pat. No. 4,079,742 to Rainer et al.

Densifying equipment is also well documented in both the patent and technical literature. For example, U.S. Pat. No. 3,277,520 (Reissue No. 27,214) to Nakahara, describes an apparatus for making densified spherical granules from cylindrical extrudates of plastic solid materials. Reynolds, in U.S. Pat. No. 3,741,703 describes an improvement in the Nakahara device. Moriya, in U.S. Pat. Nos. 3,548,334 and 3,579,719 also describes an improved apparatus for converting pelletized powdered material into spherical granules.

In "Particulate Matter", Powder Advisory Centre, London (1973), J. G. Gebbett describes the process and uses of granulation and spheronization of materials on equipment manufactured by Fuji Paudal KK of Japan and sold under the name "Marumerizer." Likewise, K. S. Murthy et al., in *Pharmaceutical Engineering,* Vol. 3, No. 4, 19 (1983), describe granulation, spheronization, and densification equipment useful in the art of pharmaceutical compounding. C. W. Woodruff et al., in *J. Pharmaceutical Sciences,* Vol. 61, No. 5, 787 (1972), describe processing variables in pharmaceutical compounding employing equipment such as the "Marumerizer."

The following additional references are cited as showing general knowledge in the art of compacted carbon products.

Forseth, in U.S. Pat. No. 4,136,975, describes a method of pelletizing carbon black.

Gunnell, in U.S. Pat. No. 4,182,736, describes a method of pelletizing carbon black.

Seligman et al., in U.S. Pat. No. 4,256,126, describes the pyrolysis of carbohydrates or like cellulosic material to form a pulverized carbon product which is added to a tobacco slurry and formed into cigarettes.

Hisatsugu et al., in U.S. Pat. No. 4,371,454 describe a process for the preparation of spherical carbon material containing pitch, amorphous carbon and a viscosity controlling agent.

Rainer et al., in U.S. Pat. No. 4,481,958, disclose the formation of carbon rods by forcing paper through a pyrolyzing die. This material is said to be useful as a tobacco substitute.

Pittman et al., in U.S. Pat. No. 4,513,765, describe a process for pelletizing mixtures of dark-fired and one-sucker tobacco useful in chewing tobacco. The pellets have a size of about 13 mm×7 mm ×4.5 mm (col. 3, 11. 14-6) and weigh from about 420 to 450 mg.

SUMMARY OF THE INVENTION

The present invention is directed to densified particulate materials comprising carbon, tobacco, or mixtures thereof, and the use of such materials in smoking products, preferably as a flavor enhancer and/or extender of natural tobacco.

The present invention is also directed to a process for the preparation of such densified materials. This process comprises the sequential steps of:

(a) forming an extrudable mixture of carbon, tobacco, or mixtures thereof, preferably with water and/or a binder;

(b) extruding said mixture into rod-type members;

(c) feeding said rod-type members to a centrifugal granulation apparatus; and (d) subjecting said rod-type members to sufficient centrifugal force in said granulation apparatus for a sufficient period of time such that the resulting particulate product has a density at least 20 percent greater than the extruded rod-type members.

As used herein, the term "centrifugal granulation apparatus" is used to define those articles of manufacture which by the action of centrifugal force on extruded mixtures of solid powders and moisture (or other solvent), are preferably used to form small (i.e., less than about 15 mm diameter), nearly uniform, spherical granules. Other shapes, e.g., rod-like, oblong, and the like, may also result from such apparatus, but spherical granules are most preferred for use herein. Such apparatus are known in the art and are commercially available from many manufacturers. The preferred apparatus for conducting the process of the present invention is available from Fuji Paudal KK under the tradename "Marumerizer."

The present invention is also related to cigarette-type and pipe-type smoking articles utilizing the densified particulate materials of the present invention as an extender of the fuel and/or as a flavor enhancer.

In cigarette-type smoking articles, the densified particulate material of the present invention may also serve as a substrate or carrier for an aerosol forming substance. The use of densified particulate tobacco, in whole or in part, as such a substrate affords many advantages heretofore unavailable in cigarette-type smoking articles.

The use of the densified particulate materials of the present invention in conventional tobacco products, i.e., cigarettes, cigars, pipe tobacco, and the like, affords advantages heretofore unavailable. For example, the use of densified tobacco, prepared according to the present invention, concentrates the flavor and aroma qualities of that tobacco. Very little material need be added to a conventional tobacco mixture to dramatically improve the flavor characteristics thereof.

Densified carbon may be used in conventional smoking materials as an extender or filler. Preferably, the carbon will not add any noticeable aromas or flavors to the mainstream or sidestream, and less tobacco will be needed per article. Preferably, a mixture of densified carbon and densified tobacco is used, both as an extender/filler and as a flavor enhancer. Such a mixture may be prepared from independently densified products or the carbon and tobacco may be densified together.

Similarly, the use of densified products of tobacco and/or carbon in cigarette-type smoking articles provides a unique flavor source for such products. Preferred smoking articles have been prepared which are able to provide the user with many of the sensations and benefits of cigarette smoking without the necessity of burning tobacco. Such articles preferably utilize a clean burning, carbonaceous fuel element, in conjunction with means for generating an aerosol. This aerosol generating means may include the densified carbon and/or tobacco of the present invention, one or more aerosol forming components, or other desirable ingredients.

As used herein, the term "smoking products" includes cigarettes, cigarette-type smoking articles and devices, cigars, cigarillos, pipes, tobacco, tobacco substitutes and the like.

DETAILED DESCRIPTION OF THE PREFERRED EMBODIMENTS

Figure 1:
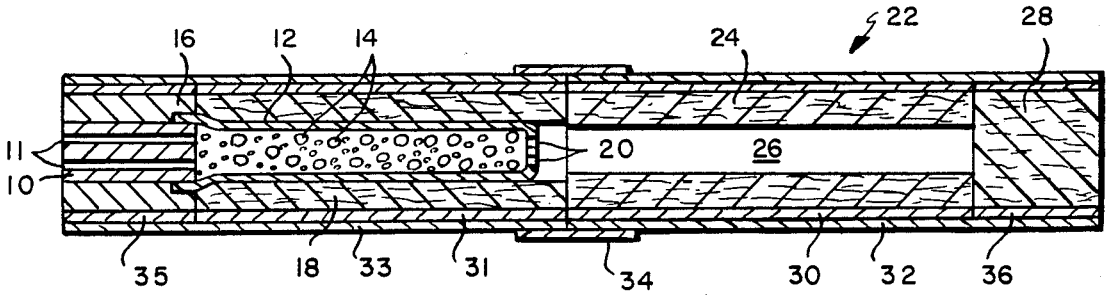
FIG. 1 illustrates a longitudinal view of one preferred cigarette-type smoking article which may include the densified particulate material of the present invention.

The present invention relates to densified particulate materials comprising carbon, tobacco, or mixtures thereof, the preparation thereof, and the use of such materials in smoking products, both conventional smoking products, i.e., cigarettes, pipes, etc., and cigarette-type or pipe-type smoking articles.

As used herein the term "densified" is used to describe the physical change occurring in materials treated in a densifying/spheronizing process, i.e., a process wherein mass is mechanically compacted and shaped by centrifugal forces, in an appropriate apparatus, into a small area.

Typically, after densification, the density of a treated substance (in g/cm$^3$) is at least about 20% greater than the density of the untreated substance, i.e., the raw material after the addition of moisture (or other solvent) and/or binder(s) and following extrusion, but before treatment in the densifying equipment. Preferably, the increase in density is at least on the order of from about 50% to 100%, or greater.

As used herein, the term "carbon" refers to all forms of adsorbent or absorbent carbon, both activated and nonactivated. It also includes carbons from whatever source, so long as the carbon is porous and capable of densification. Nonporous carbons, or carbons of extremely high density are not useful herein.

All forms of tobacco are useful herein, and densification thereof according to the teachings of the present disclosure affords a unique product, useful in both conventional cigarettes and in cigarette-type smoking articles, especially as a flavor enhancer.

As stated above, commercially available densification equipment is preferably employed for the densification of the carbon and/or tobacco of the present invention. The most preferred apparatus is the "Marumerizer," available from Fuji Paudal Co., distributed by Luwa Corporation of Charlotte, N.C.

The material to be densified is preferably, but not necessarily, first admixed with one or more binders. Depending upon the final use of the densified material, the binder choices may vary widely. In the present invention, since the end use of the material is in a smoking product, the choice of binder should be one that will not produce harsh aromas or tastes.

Preferred binders for use in the present invention include polysaccharide gums, such as plant exudates; Arabic, Tragacanth, Karaya, Ghatti; plant extracts, pectin, arabinoglactan; plant seed flours, locust bean, guar, psyllium seed, quincy seed; seaweed extracts, agar, alginates, carrageenan, and furcellaran; cereal starches, corn, wheat, rice, waxy maize, sorghum, waxy sorghum, tuber starches, potato, arrowroot, and tapioca.

Modified gums which may be useful as binders herein include, cellulose derivatives, sodium carboxymethylcellulose, methylcellulose, hydroxypropylmethylcellulose, methylethylcellulose, and hydroxypropylcellulose. The microbial fermentation gums, such as Xanthan and dextran may also be used as binders. Modified alginates, such as propylene glycol alginate; and modified starches; such as carboxymethyl starch, hydroxyethyl starch and hydroxypropyl starch, may likewise be used.

The amount of binder optionally used will vary both with the type of binder and nature of the other ingredients present in the mixture. Generally, for the preferred smoking products described herein, from about 0.5 to 10, preferably from about 1 to 5, weight percent of binder is sufficient.

The material (or mixture of materials) to be densified is generally admixed with sufficient solvent, preferably water, to make an extrudable paste. The amount of solvent necessary to prepare such a paste may be readily determined by the skilled artisan. Other solvents, e.g., aqueous mixtures of glycerin and the like may be used should the skilled artisan so desire. The paste is extruded using a standard ram or piston type extruder to afford a semi-solid particle having a rod-type shape. In preferred embodiments, the extruder is a commercially available unit sold under the name "Xtruder" by the Luwa Corporation of Charlotte, NC.

In preferred embodiments, this rod shaped semi-solid is fed to a commercial densifying machine such as the "Marumerizer", wherein it is shaped and densified by centrifugal force over a time period of from about 0.01 to 5 hours. Depending upon the amount of centrifugal force exerted upon the rod-like material the resulting shape of the densified particles may range from rod-like (generally shorter than as extruded) to spherical (almost perfectly round). All of the possible shapes are useful herein, but the spherical (i.e., round) particles are preferred as these are generally the most densified.

Depending upon the type of smoking article in which the densified material is to be employed, the size of the granules may vary from as small as about 0.5 mm, and generally up to about 7 to 8 mm in diameter. Cigarettes will normally utilize very small particles, i.e., generally less than about 2 mm in diameter, while cigarette-type smoking articles may use single large spherical particles up to the diameter of the article, or they may use a variety of large and small sized particles. The preferred densifying equipment, the Marumerizer, can produce spherical particles ranging from about 0.5 mm to 15 mm in diameter. Larger particles, i.e., greater than about 7 to 8 mm in diameter, may be useful in cigars and pipes, or may be broken into smaller particles for incorporation into cigarettes or cigarette-type smoking articles.

It is anticipated that other centrifugal force type densification equipment will provide similar useful materials, and the present invention is not to be considered as limited to so-called "Marumerized" materials.

In addition to binders and/or water, other ingredients such as flavors, spray dried tobacco extracts, and the like may be added to the material either before or after extrusion and/or densification.

The use of the densified tobacco and/or carbon materials of the present invention in a pipe- or cigarette-type smoking article provides a unique flavor source for such products.

Preferred smoking articles have been prepared which are able to provide the user with many of the sensations and benefits of cigarette smoking without the necessity of burning tobacco.

Such articles preferably utilize a clean burning, carbonaceous fuel element, in conjunction with means for generating an aerosol. This aerosol generating means may include the densified carbon and/or tobacco of the present invention, one or more aerosol forming components, or other desirable ingredients.

Preferred pipe- or cigarette-type smoking articles which may be improved by the use of the densified particulate material of the present invention are described in the following patent applications:

| Applicants | U.S. Ser. No. | Filed |
|---|---|---|
| Sensabaugh et al. | 650,604 | September 14, 1984 |
| Shannon et al. | 684,537 | December 21, 1984 |
| Clearman et al. | 791,721 | October 28, 1985 |
| Shelar | 840,114 | March 14, 1986 |

the disclosures of which are, to the extent necessary, incorporated herein by reference.

One such preferred cigarette-type smoking article is set forth in FIG. 1 accompanying this specification. Referring to this Figure there is illustrated a cigarette-type smoking article having a small (4.5 mm×10 mm) carbonaceous fuel element 10 with several passageways 11 therethrough. This fuel element is formed from an extruded mixture of carbon (from carbonized paper), SCMC binder, $K_2CO_3$, and water, as described in the above-cited patent applications.

Overlapping the mouthend of the fuel element 10 is a metallic container 12, about 4.5 mm in diameter and about 30 mm in length. The container holds a substrate material 14 which at least in part is the densified tobacco and/or carbon of the present invention. In addition, the substrate includes at least one aerosol forming substance, such as propylene glycol or glycerin.

The periphery of fuel element 10 in this article is surrounded by a jacket 16 of resilient insulating fibers, such as glass fibers, and container 12 is surrounded by a jacket of tobacco 18. The rear portion of container 12 is sealed and is provided with 2 slits 20 (each 0.65 mm×3.45 mm) for the passage of the aerosol forming materials to the user.

At the mouth end of tobacco jacket 18 is situated a mouthend piece 22 comprised of a cellulose acetate cylinder 24 which provides aerosol passageway 26, followed by a low efficiency cellulose acetate filter piece 28. As illustrated, the article (or portions thereof) is overwrapped with one or more layers of cigarette papers 30–36.

Upon lighting, the carbonaceous fuel element burns, generating the heat used to volatilize the aerosol forming substance or substances in the aerosol generating means. This heat also causes at least a portion of the volatiles in the densified tobacco or tobacco/carbon mixture to be released. Because of the high density of the material of the present invention, such volatiles are not rapidly released, but are instead released slowly over the life of the fuel element. Because the preferred fuel element is relatively short, the hot, burning fire cone is always close to the aerosol generating means which maximizes heat transfer to the aerosol generating means, and resultant production of aerosol.

The carbonaceous fuel element usually begins to burn over substantially all of its exposed surface within a few puffs. Thus, that portion of the fuel element adjacent to the aerosol generator becomes hot quickly, which significantly increases heat transfer to the aerosol generator.

Control of heat transfer to the aerosol generating means is important both in terms of transferring enough heat to produce sufficient aerosol and in terms of avoiding the transfer of so much heat that the aerosol former is degraded.

Heat transfer is enhanced by the heat conductive material employed in the preferred conductive container for the aerosol forming substances, which aids in the distribution of heat to the portion of the aerosol forming substance which is physically remote from the fuel. This helps produce good aerosol in the early puffs.

The control of heat transfer is also aided by the use of an insulating member as a peripheral overwrap over at least a part of the fuel element. Such an insulating member helps ensure good aerosol production by retaining and directing much of the heat generated by the burning fuel element toward the aerosol generating means.

The control of heat transfer from the fuel element to the aerosol generating means may also be aided by the presence of a plurality of passageways in the fuel element, which allow the rapid passage of hot gases to the aerosol generator, especially during puffing.

Because the aerosol forming substance is physically separate from the fuel element, the aerosol forming substance is exposed to substantially lower temperatures than are generated by the burning fuel, thereby minimizing the possibility of its thermal degradation. This also results in aerosol production almost exclusively during puffing, with little or no aerosol production from the aerosol generating means during smolder.

Figure 2:
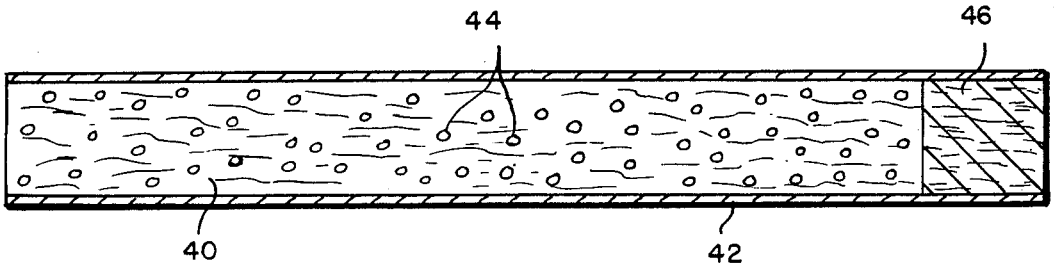
FIG. 2 illustrates a longitudinal view of one preferred cigarette showing the incorporation therein of the densified particulate material of the present invention.

The densified particulate materials of the present invention may likewise be used in conventional tobacco products, i.e., cigarettes, cigars, pipe tobacco, and the like, in which they afford many heretofore unavailable advantages. FIG. 2 illustrates one such embodiment. As illustrated, a conventional cigarette comprising a rod of tobacco 40 is surrounded by a paper wrapper 42. Distributed within this tobacco rod are small particles of densified tobacco and/or carbon 44. The cigarette is completed with a conventional cellulose acetate tow filter tip 46.

The use of densified tobacco, prepared according to the present invention, concentrates the flavor and aroma qualities of that tobacco. Very little material (e.g., as little as 10 mg) need be added to a conventional tobacco mixture to improve the flavor characteristics thereof. For more dramatic changes, increasing the amount of densified tobacco in a conventional "ultra-light cigarette" (e.g., 50 mg) causes that type of cigarette to taste like a "full-flavor" cigarette.

Variations in the amount and/placement of the densified tobacco also affects performance of the article. Exposure of the densified tobacco to high temperatures can cause harsh tastes/aromas. Preferably, the densified tobacco is placed close to the mouthend of a conventional cigarette to enrich the flavor of the mainstream aerosol.

Densified carbon may be used in conventional smoking materials as an extender or filler. Preferably, the carbon will not add any noticeable aromas or flavors to the mainstream or sidestream, and less tobacco will be needed per article. Up to about 30 weight percent of the tobacco in a conventional cigarette may be replaced by densified carbon.

A mixture of densified carbon and densified tobacco may also be used, providing the article with both an extender/filler and a flavor enhancer. Such a mixture may be prepared from independently densified products or the carbon and tobacco may be densified together.

The present invention will be further illustrated with reference to the following examples which aid in the understanding thereof, but which are not to be construed as limitations thereof. All percentages reported herein, unless otherwise specified, are percent by weight. All temperatures are expressed in degrees Celsius and are uncorrected.

EXAMPLE 1

Carbon powder, PCB-G, was obtained from Calgon Carbon Corporation. Nine pounds of this carbon powder and one pound of sodium carboxymethyl cellulose (Hercules - Grade 7HF) was mixed in a kneader (Model KDHJ-20, Fuji Paudal) along with 4500 g of water. After thorough mixing, the material became dough-like.

This dough-like mix was transferred to an extruder (Model EXD-100, Fuji Paudal) whence extrusions of both 1.5 mm and 0.8 mm diameter were made.

The extrudate was transferred to a commercial densifier (the Marumerizer, Model QJ-400, Fuji Paudal) and spheronized at a speed of 1000 rpm. The spheronized and densified particles were then dried in a fluid bed dryer (Model MDB-400, Fuji Paudal). The final particle sizes were about 1 mm and about 0.5 mm in diameter respectively.

The density of the resulting "densified" PCB-G carbon powder was measured by mercury intrusion and found to be 10.1 g/cc. This represented an increase of 44% over similar material not treated to the densification step.

EXAMPLE 2

Flue cured tobacco strips were dried to approximately 5% moisture. The strips were ground on a Fitz Mill and then transferred to a Sweco Vibro Energy Ball Mill for the final grinding. After grinding for about 30 minutes, the tobacco was discharged to a plastic bag. A sample of the ground tobacco was obtained for sieve analysis. The sample of tobacco was reordered to about 9% moisture to minimize static charges while sieving. The sieving was done on an ATM Sonic Sifter, Model L3P, Series E - ATM Corporation. A 5 g sample was used, sifting time was 15 minutes. See Table 1.

TABLE 1

| SIEVE MESH SIZE | TOBACCO % |
|---|---|
| Retained on 40 | 6.0 |
| Retained on 60 | 4.0 |
| Retained on 120 | 12.0 |
| Retained on 140 | 14.0 |
| Retained on 200 | 16.0 |
| Retained on 325 | 38.0 |
| Thru 325 | 10.0 |

The powdered tobacco (2,227 g) and water (497 g) was processed on the same equipment utilized in Example 1. The resulting spherical particles had an average diameter of from about 1 mm to 1.5 mm. After drying, the spheronized and densified tobacco had a density of 0.67 g/cc, which, when compared to a density of 0.42 g/cc for the tobacco powder before being processed through the Marumerizer system, represents a 59% increase in density.

EXAMPLE 3

Flue cured tobacco was processed as in Example 2, except that the mixture also contained 15% (by weight) glycerin. The tobacco was again densified, spheronized, and made into a flowable product. The resulting spherical particles had an average diameter of from about 1 mm to 1.5 mm.

EXAMPLE 4

A blend of cigarette tobacco (40% by weight), Burley tobacco (20% by weight) and carbon (40% by weight (Union Carbide Porous Graphite −60) was processed as described in Example 1.

The porous graphite had previously been ground on a Wiley Mill to a fine powder. The porous graphite also contained glycerin (28% by weight). This mixture was densified and spheronized without the addition of any binders. The resulting spherical particles had an average diameter of from about 1 mm to 1.5 mm. The increase in density for this product was 25%.

EXAMPLE 5

Preferred cigarette-type smoking articles of the type substantially as illustrated in FIG. 1 were prepared in the following manner:

The fuel element (10 mm long, 4.5 mm o.d.) having an apparent (bulk) density of about 0.86 g/cc, was prepared from carbon (90 wt. percent), SCMC binder (10 wt. percent) and $K_2CO_3$ (1 wt. percent).

The carbon was prepared by carbonizing a non-talc containing grade of Grand Prairie Canadian Kraft paper under a nitrogen blanket, at a step-wise increasing temperature rate of about 10° C. per hour to a final carbonizing temperature of 750° C.

After cooling under nitrogen to less than about 35° C., the carbon was ground to a mesh size of minus 200. The powdered carbon was then heated to a temperature of up to about 850° C. to remove volatiles.

After cooling under nitrogen to less than about 35° C., the carbon was ground to a fine powder, i.e., a powder having a particle size range of from less than about 10 microns and up to about 50 microns.

This fine powder was admixed with SCMC binder (9 parts carbon: 1 part binder), the $K_2CO_3$, and sufficient water to make a stiff, dough-like paste.

Fuel elements were extruded from this paste having as a preferred multiple passageway configuration, the seven hole, closely spaced arrangement, substantially as described in Shelar, U.S. Ser. No. 840,114, supra.

The capsule used to construct the illustrated smoking article was prepared from aluminum tubing about 4 mil thick (0.1016 mm), about 32 mm in length, having an outer diameter of about 4.5 mm. The rear 2 mm of the container was crimped to seal the mouth end of the container. The sealed end of the capsule was provided with two slot-like openings (each about 0.65×3.45 mm, spaced about 1.14 mm apart) to allow passage of the aerosol former to the user.

The substrate material for the aerosol generating means was a high surface area alumina (surface area=280 $m^2/g$) such as that available from W. R. Grace & Co. (designated SMR-14-1896), having a mesh size of from −14, +20 (U.S.). Before use herein, this alumina was sintered at a soak temperature of from about 1400° to 1550° C., for about one hour and cooled. The alumina was then washed with water and dried.

This sintered alumina was combined with levulinic acid and glycerin to a final weight percentage as follows:

| | |
|---|---|
| Alumina | 75.0% |
| Glycerin | 24.3% |
| Levulinic Acid | 0.7% |

The capsule was filled with about 200 mg of a 1: mixture (by weight) of this treated alumina and the densified material of Example 3.

The fuel element was inserted into the open end of the filled capsule to a depth of about 3 mm. The fuel element capsule combination was overwrapped at the fuel element end with a 10 mm long, glass fiber jacket of Owens-Corning 6437 (having a softening point of about 650° C.), with 4 wt. percent pectin binder, to a diameter of about 7.5 mm. The glass fiber jacket was then overwrapped with Kimberly-Clark's P878-63-5 paper.

A 7.5 mm diameter tobacco rod (28 mm long) with a 646 plug wrap overwrap (e.g., from a non-filter cigarette) was modified to have a longitudinal passageway (about 4.5 mm diameter) therein. The jacketed fuel element capsule combination was inserted into the tobacco rod passageway until the glass fiber jacket abutted the tobacco. The jacketed sections were joined together by Kimberly-Clark's P878-16-2 paper.

A cellulose acetate mouthend piece (30 mm long), of the type illustrated in FIG. 1, overwrapped with-646 plug wrap, was joined to a filter element (10 mm long), also overwrapped with 646 plug wrap, by RJR Archer Inc. 8-0560-36 tipping with lip release paper.

The combined mouthend piece section was joined to the jacketed fuel element - capsule section by a small section of white paper and glue.

The present invention has been described in detail, including the preferred embodiments thereof However, it will be appreciated that those skilled in the art, upon consideration of the present disclosure, may make modifications and/or improvements on this invention and still be within the scope and spirit of this invention as set forth in the following claims.

What is claimed is:

1. A process for preparing densified particulate materials suitable for use in smoking products, which process comprises the sequential steps of:

(a) forming an extrudable mixture comprising a suitable solvent and a solid selected from the group consisting of carbon, tobacco, and mixtures thereof;

(b) extruding said mixture into rod-type members;

(c) feeding said rod-type members to a centrifugal granulation apparatus; and (d) subjecting said rod-type members to sufficient centrifugal force in said granulation apparatus for a sufficient period of time to increase their density by at least 20 percent.

2. Densified particulate material comprising tobacco, carbon, or mixtures thereof, prepared in accordance with the process of claim 1.

3. The densified particulate material of claim 2, which further comprises a binder.

4. The densified particulate material of claim 2 or 3, wherein the extrudable mixture consists essentially of tobacco, binder and water.

5. The densified particulate material of claim 2 or 3, wherein the extrudable mixture consists essentially of carbon, binder and water.

6. The densified particulate material of claim 2, wherein the extrudable mixture consists essentially of tobacco and water.

7. The densified particulate material of claim 2, wherein the extrudable mixture consists essentially of carbon and water.

8. The densified particulate material of claim 5 or 7, wherein the carbon is activated carbon.

9. A smoking product containing material for smoking and the densified particulate material of claim 2, 3, 6, or 7.

10. The smoking product of claim 9, wherein the material for smoking comprises a tobacco filler.

11. The smoking product of claim 9, or 10, which is in the form of a cigarette.

12. The smoking product of claim 9 or 10, which is in the form of a pipe.

13. A cigarette-type smoking article comprising:

(a) a fuel element; and (b) a physically separate aerosol generating means including at least one aerosol forming substance, and which further contains the densified particulate material of claim 2, 3, 6, or 7, in either the fuel element, the aerosol generating means, or both.

* * * * *

UNITED STATES PATENT AND TRADEMARK OFFICE

CERTIFICATE OF CORRECTION

PATENT NO. : 4,893,639

DATED : January 16, 1990

INVENTOR(S) : Jackie L. White

It is certified that error appears in the above—identified patent and that said Letters Patent is hereby corrected as shown below:

Title page, Col. 2, line 3, "Xtuder" should be --"Xtruder"--.

Column 9, Line 53, "1:" should be --1:1--.

Column 9, Line 58, "element capsule" should be --element-capsule--.

Column 10, Line 52, insert "a" after containing.

Signed and Sealed this

Fifteenth Day of January, 1991

*Attest:*

*Attesting Officer*

HARRY F. MANBECK, JR.

*Commissioner of Patents and Trademarks*